US007096973B2

(12) United States Patent
Ikuta et al.

(10) Patent No.: US 7,096,973 B2
(45) Date of Patent: Aug. 29, 2006

(54) POWER TOOL

(75) Inventors: Hiroki Ikuta, Anjo (JP); Takuo Arakawa, Anjo (JP); Takahiro Kawakami, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/843,036

(22) Filed: May 10, 2004

(65) Prior Publication Data

US 2004/0222001 A1 Nov. 11, 2004

(30) Foreign Application Priority Data

May 9, 2003 (JP) ..... 2003-131551
Mar. 15, 2004 (JP) ..... 2004-072721

(51) Int. Cl.
*B25D 11/00* (2006.01)

(52) U.S. Cl. ..... 173/201; 173/48; 173/162.1

(58) Field of Classification Search ..... 173/47, 173/48, 162.1, 117, 122, 201, 210, 211; 74/574.4, 74/603, 604
See application file for complete search history.

(56) References Cited

U.S. PATENT DOCUMENTS 3,688,848 A * 9/1972 Vick et al. ..... 173/201
4,014,392 A * 3/1977 Ross ..... 173/162.1
5,607,023 A 3/1997 Palm
5,678,641 A * 10/1997 Manschitz et al. ..... 173/48
6,000,310 A * 12/1999 Shilkrut et al. ..... 173/162.1
2002/0185288 A1 12/2002 Hanke et al.

FOREIGN PATENT DOCUMENTS

JP 52-109673 9/1977
JP 2002254352 9/2002
JP 2003-11073 1/2003

* cited by examiner

*Primary Examiner*—Scott A. Smith
(74) *Attorney, Agent, or Firm*—Lahive Cockfield, LLP; Anthony A. Laurentano, Esq.

(57) ABSTRACT

It is an object of the invention to provide a technique for further improving the vibration reducing performance in the power tool, while avoiding complicating the construction of the power tool. According to the present invention, a representative power tool may comprise a striker, a tool bit and a vibration reducer. The vibration reducer serves to reduce vibration on the striker by reciprocating in a direction opposite to the reciprocating direction of the striker. The path of the center of gravity of the vibration reducer is arranged to coincide with a path of the center of gravity of the striker. With such construction, because rotating moment is not exerted onto the reciprocating cylinder during the operation of the power tool, vibration reduction can be performed in a stable manner.

4 Claims, 7 Drawing Sheets

POWER TOOL

BACKGROUND OF THE INVENTION

1. Field of the Invention

The present invention relates to a power tool, and more particularly, to a technique of reducing and alleviating vibration in a power tool, such as a hammer and a hammer drill.

2. Description of the Related Art

Japanese non-examined laid-open Patent Publication No. 52-109673 discloses a hammer with a vibration reducing device. The known hammer includes a vibration-isolating chamber provided in the region under the body housing of the hammer. A dynamic vibration reducer is housed in the vibration-isolating chamber and serves to reduce and alleviate strong vibration developed in the axial direction of the hammer during the operation.

However, the vibration-isolating chamber is separately formed within the body housing and components parts of the dynamic vibration reducer are incorporated therein. Therefore, the construction and assembling operation are complicated and the weight of the entire hammer is increased. Further, because the space for housing the dynamic vibration reducer must be ensured, the appearance of the hammer is impaired.

SUMMARY OF THE INVENTION

Accordingly, it is an object of the present invention to provide a technique for further improving the vibration reducing performance in the power tool, while avoiding complicating the construction of the power tool.

According to the present invention, a representative power tool may comprise a striker, a tool bit and a vibration reducer. The striker reciprocates by pressure fluctuations within a cylinder. The tool bit performs a predetermined operation by a striking force of the striker. The vibration reducer serves to reduce vibration on the striker by reciprocating in a direction opposite to the reciprocating direction of the striker. The path of the center of gravity of the vibration reducer is arranged to coincide with a path of the center of gravity of the striker. With such construction, the vibration reducer can be closely associated with the striker without requiring any vibration-isolating chamber, it can be avoided to complicate the construction of the power tool with a vibration reducing function. Further, because the paths of the center of gravity of the striker and the vibration reducer coincide to each other and thus rotating (turning) moment is not exerted onto the reciprocating cylinder during the operation of the power tool, vibration reduction can be performed in a stable manner.

Other objects, features and advantages of the present invention will be readily understood after reading the following detailed description together with the accompanying drawings and the claims.

DETAILED DESCRIPTION OF THE INVENTION

Figure 1:
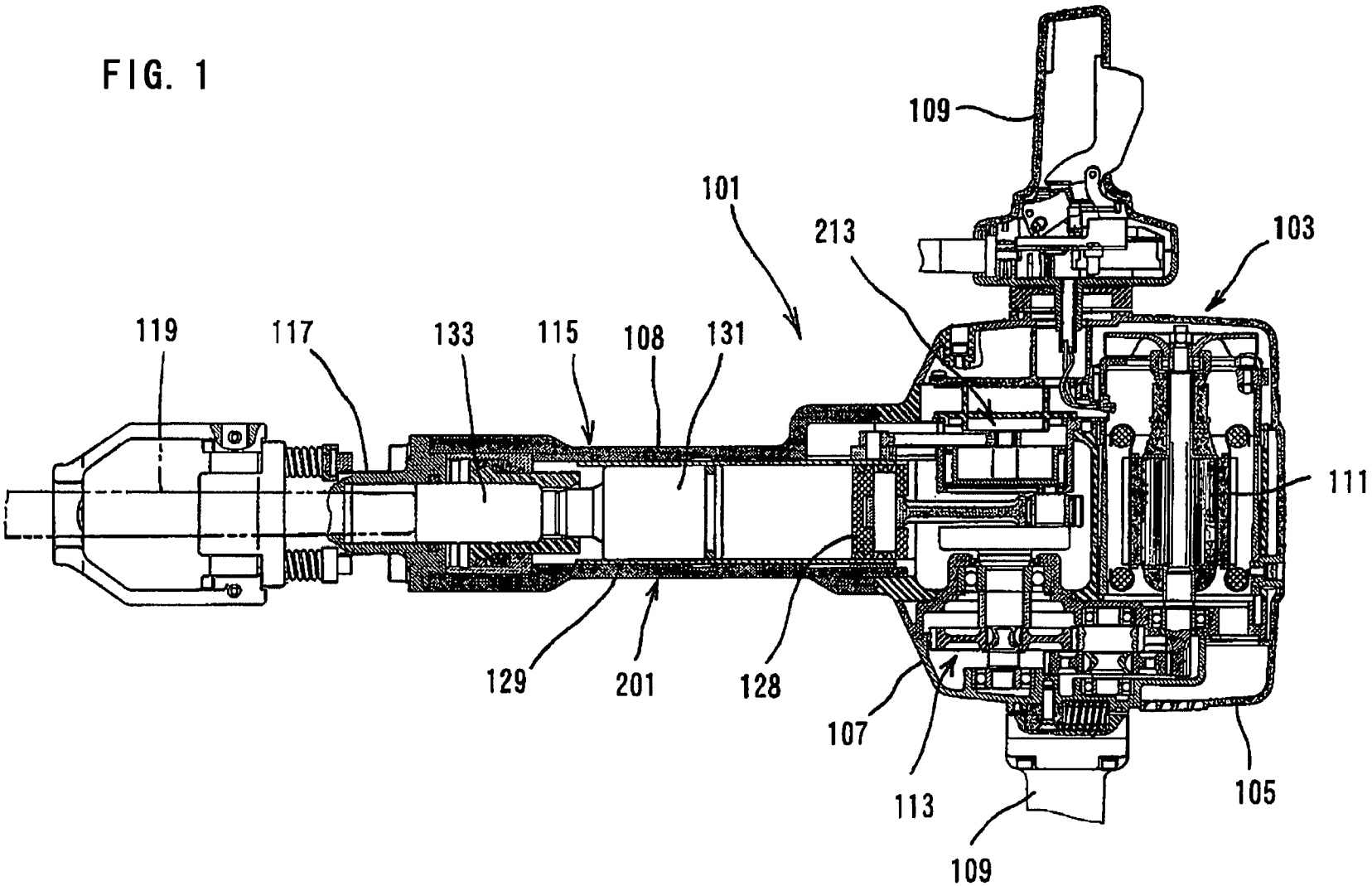
FIG. 1 is a sectional plan view schematically showing an entire electric hammer according to an embodiment of the invention.

According to the present invention, a representative power tool may comprise a striker, a tool bit and a vibration reducer. The striker reciprocates by pressure fluctuations within a cylinder. The striker may directly collide with the tool bit by pressure fluctuations within the cylinder. Alternatively, the striker may be driven by pressure fluctuations within the cylinder and caused to collide with another impact force transmitting element such as an impact bolt, which in turn is caused to collide with the tool bit. The tool bit performs a predetermined operation by a striking force of the striker. The vibration reducer serves to reduce vibration on the striker by reciprocating in a direction opposite to the reciprocating direction of the striker. The path of the center of gravity of the vibration reducer is arranged to coincide with a path of the center of gravity of the striker. With such construction, because rotating (turning) moment is not exerted onto the reciprocating cylinder during the operation of the power tool, vibration reduction can be performed in a stable manner.

In the power tool of the present invention, the cylinder may preferably reciprocate in a direction opposite to the reciprocating direction of the striker such that the reciprocating cylinder functions as a counter weight that reduces the vibration caused by the striker. In order to cause the cylinder to reciprocate, typically, a crank mechanism that converts a rotating output of a driving motor to linear motion may be used.

Because a power tool such as a hammer inherently includes a cylinder to drive the striker and such an existing cylinder can be utilized as a vibration reducer, the design of the power tool with a vibration reducing function can be simplified. Thus, the power tool can be simpler in construction and can be manufactured at reduced costs, having a lighter weight and better appearance.

The striker and the cylinder may be separately caused to reciprocate by a first crank and a second crank which respectively convert a rotating output of a driving motor to linear motion. In other words, a crank for driving the striker to reciprocate and a crank for driving the cylinder to reciprocate may be separately provided. Further, in an actual operation of the power tool, the striker typically starts to strike the tool bit with a certain time delay after the movement of the piston that causes pressure fluctuations within the cylinder. Therefore, the first crank and the second crank may preferably be driven with a different timing so that the cylinder reciprocates in a direction opposite to the reciprocating direction of the striker. The striker and the cylinder may preferably be driven via the first and the second crank mechanisms by using a common driving motor.

Instead of utilizing the cylinder as a vibration reducer, the vibration reducer may comprise a counter weight disposed along the entirety or part of the outer circumferential surface of the cylinder. In such case, the counter weight reciprocates to alleviate an impact force during hammering operation, thereby performing vibration reduction against the impact force. In utilizing such counter weight, a rotation preventing mechanism may preferably be disposed between the body and the counter weight in order to prevent the counter weight from moving in the circumferential direction of the cylinder. Further, an air vent may be provided in the cylinder such that outside air can be introduced into the cylinder when the pressure within the cylinder decreases. The air vent may be opened and closed when the counter weight reciprocates on the cylinder.

Further, the power tool may comprise first crank mechanism to drive the striker by reciprocating a driver within the cylinder and second crank mechanism to reciprocate the counter weight. The first and second crank mechanisms may be supported by first and second bearings. By such construction, the driver and the counter weight can be driven with stability.

Each of the additional features and method steps disclosed above and below may be utilized separately or in conjunction with other features and method steps to provide improved power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

FIRST REPRESENTATIVE EMBODIMENT

Figure 2:
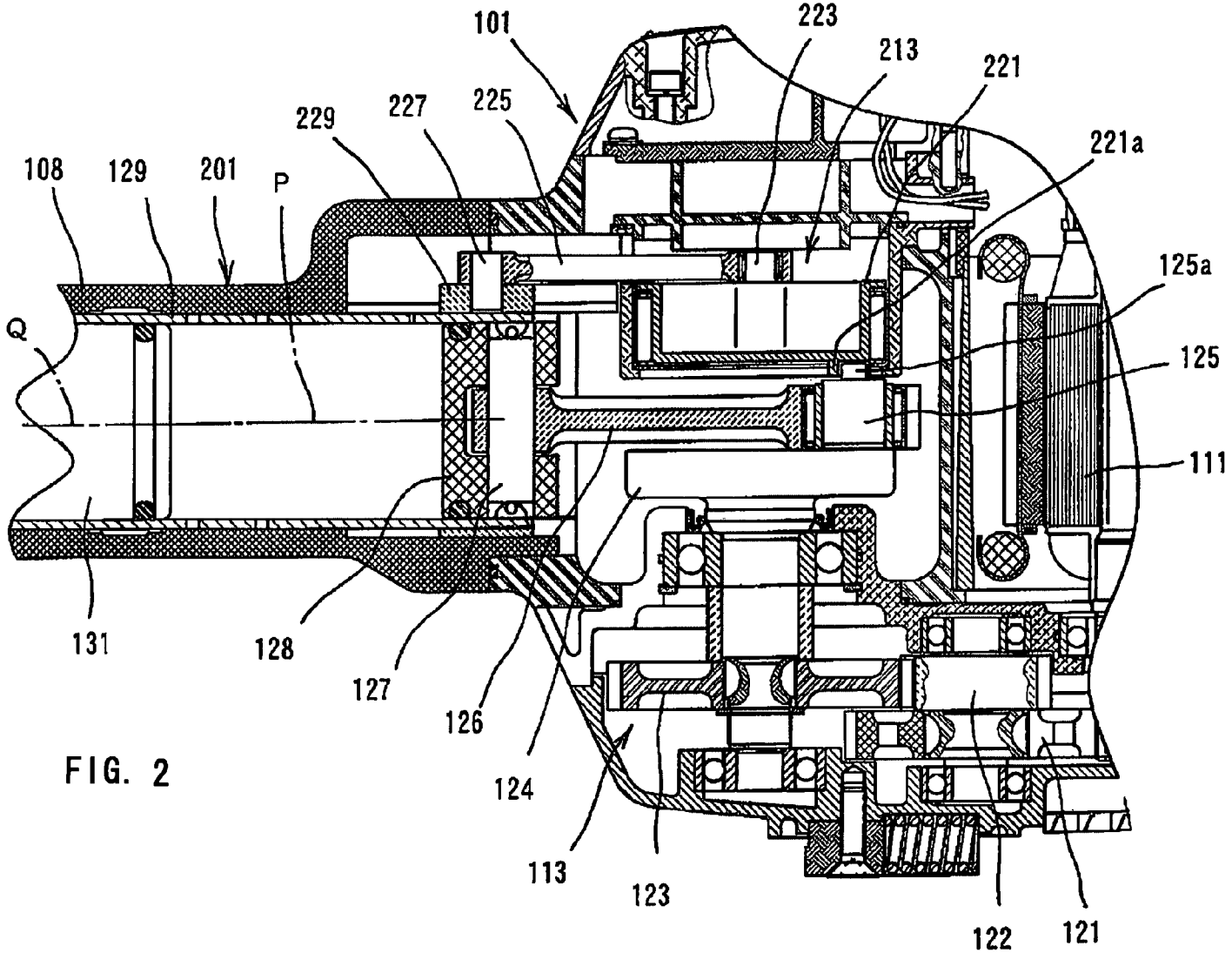
FIG. 2 is a sectional plan view of an essential part of the representative electric hammer, showing a piston located at a non-compression side dead point.

First representative embodiment of the present invention will now be described with reference to the drawings. As shown in FIG. 1, an electric hammer 101 as a representative embodiment of the power tool according to the present invention comprises a body 103, a tool holder 117 connected to the tip end region of the body 103, and a hammer bit 119 detachably coupled to the tool holder 117. The hammer bit 119 is a feature that corresponds to the "tool bit" according to the present invention. FIG. 2 shows the electric hammer 101 in plan view.

The body 103 includes a motor housing 105, a gear housing 107 and a handgrip 109. The motor housing 105 houses a driving motor 111. The gear housing 107 houses a first motion converting mechanism 113, a second motion converting mechanism 213 and a striking mechanism 115. The first motion converting mechanism 113 is adapted to convert the rotating output of the driving motor 111 to linear motion and then to transmit it to the striking mechanism 115. As a result, an impact force is generated in the axial direction of the hammer bit 119 via the striking mechanism 115.

Further, the second motion converting mechanism 213 is adapted to convert the rotating output of the driving motor 111 to linear motion and then to transmit it to a cylinder 129 that defines a vibration reducing mechanism 201. As a result, the cylinder 129 is caused to reciprocate in its axial direction as to correspond to the impact force by the striking movement of the hammer bit 119. Thus, vibration caused in the hammer 101 can be alleviated or reduced. The hammer 101 may be configured such that it can be switched over by the user to a hammer drill mode and a hammer-drill mode.

FIG. 2 shows a detailed construction of the first and second motion converting mechanisms 113, 213 of the electric hammer 101. The first motion converting mechanism 113 includes a driving gear 121, an intermediate gear 122, a driven gear 123, a first crank disc 124, a first eccentric shaft (crank pin) 125 and a first connecting rod 126. The driving gear 121 is rotated in a vertical plane by the driving motor 111. The intermediate gear 122 rotates together with the driving gear 121 and the driven gear 123 engages the intermediate gear 122. The first crank disc 124 rotates together with the driven gear 123. The first eccentric shaft 125 is eccentrically disposed in a position displaced from the center of rotation of the first crank disc 124. One end of the first connecting rod 126 is loosely connected to the first eccentric shaft 125 and the other end is loosely connected to a driver in the form of a piston 128 via a first connecting shaft 127. The first crank disc 124, the first eccentric shaft 125 and the first connecting rod 126 form a first crank mechanism. The first crank mechanism is a feature that corresponds to the "first crank" according to the present invention.

Further, as shown in FIG. 1, a striking mechanism 115 includes a striker 131 and an impact bolt 133. The striker 131 is slidably disposed within the bore of the cylinder 129 together with the piston 128. The impact bolt 133 is slidably disposed within the tool holder 117 and is adapted to transmit the kinetic energy of the striker 131 to the hammer bit 119.

As shown in FIG. 2, the cylinder 129 is disposed within a barrel 108 connected to the gear housing 107 and can slide in the axial direction. The cylinder 129 functions as a counter weight for reducing vibration during hammering operation by reciprocating in a direction opposite to the sliding direction of the striker 131. In other words, the cylinder 129 that reciprocates in a direction opposite to the sliding direction of the striker 131 defines the vibration reducing mechanism 201 in the barrel 108.

In FIG. 2, a path of the center of gravity of the cylinder 129 reciprocating within the barrel 108 is shown by reference symbol "P", while a path of the center of gravity of the piston 128 as well as the striker 131 reciprocating within the cylinder 129 is shown by reference symbol "Q". The path P of the center of gravity of the cylinder 129 is arranged substantially to coincide with the path Q of the center of gravity of the piston 128 and the striker 131.

As shown in FIG. 2, the second motion converting mechanism 213 that causes the cylinder 129 to reciprocate includes a second crank disc 221, a second eccentric shaft (crank pin) 223 and a second connecting rod 225. The second eccentric shaft 223 is eccentrically disposed in a position displaced from the center of rotation of the second crank disc 221 on the edge portion of the second crank disc 221. One end of the second connecting rod 225 is loosely connected to the second eccentric shaft 223 and the other end is loosely connected to the cylinder 129 via a second connecting shaft 227. The second crank disc 221, the second eccentric shaft 223 and the second connecting rod 225 form a second crank mechanism. The second crank mechanism is a feature that corresponds to the "second crank" according to the present invention.

Figure 3:
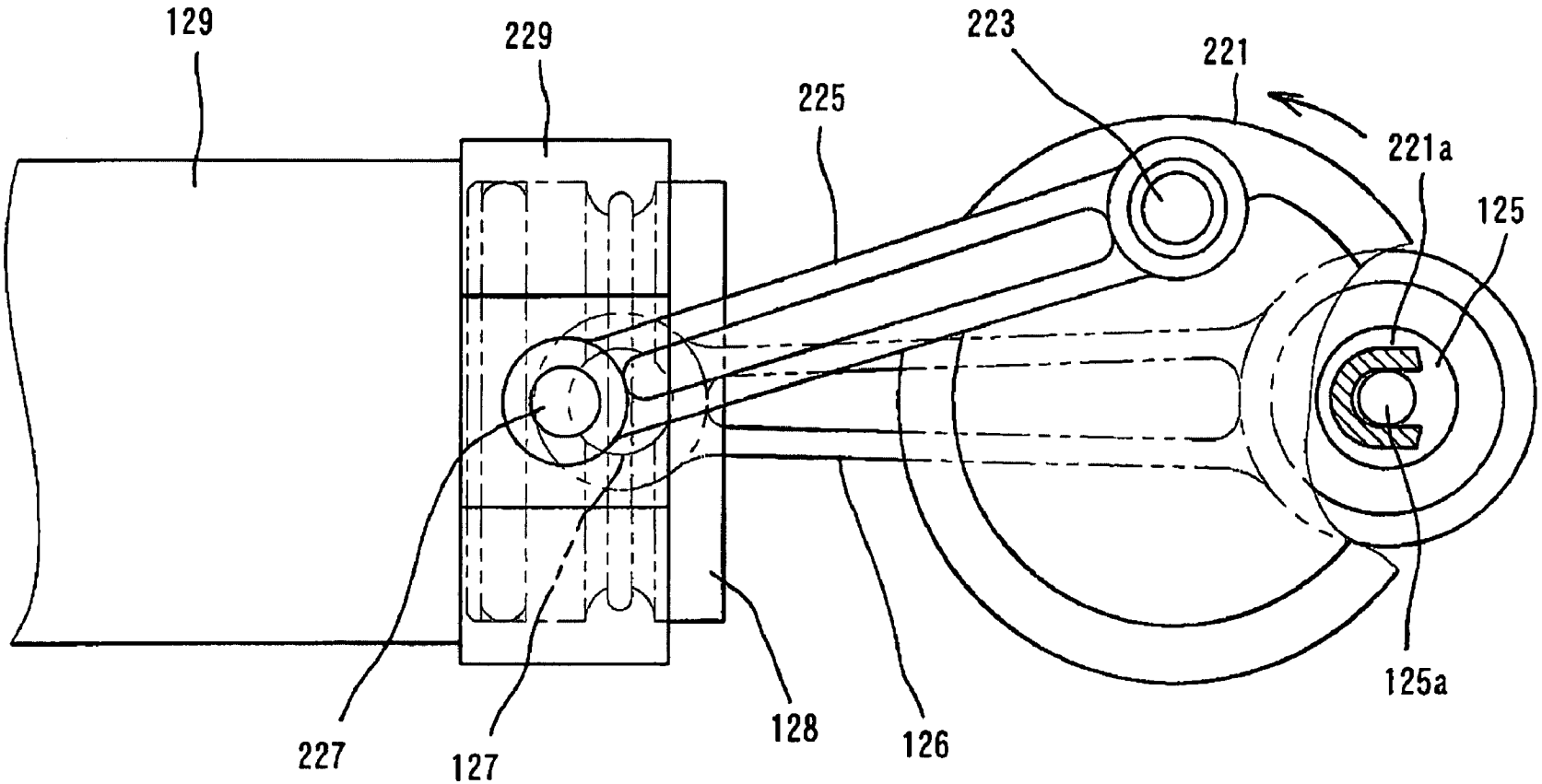
FIG. 3 is a plan view schematically showing a relative positional relationship of the piston, the cylinder and the first and the second connecting rods when the hammer is in the state shown in FIG. 2.

The second crank disc 221 is arranged such that its axis of rotation substantially coincides with the axis of rotation of the first crank disc 124 of the first motion converting mechanism 113. The second crank disc 221 is loosely connected to the first eccentric shaft 125 in a position displaced from its axis of rotation. As shown in FIG. 3, this connection is achieved by the fact that a U-shaped engaging portion 221 *a* of the second crank disc 221 loosely engages with a small-diameter portion 125*a* of the first eccentric shaft 125. Thus, power is taken out from the power transmission path of the first motion converting mechanism 113 driven by the driving motor 111 and such power is utilized to drive the second motion converting mechanism 213. The second connecting rod 225 is connected to the cylinder 129 via a joint ring 229 fitted around the axial end of the cylinder 129 and the second connecting shaft 227 fitted in the joint ring 229.

A phase difference is provided between the reciprocating movement of the striker 131 and the reciprocating movement of the cylinder 129. By such phase difference, the cylinder 129 reciprocates in a direction opposite to the reciprocating direction of the striker 131. The striker 131 is driven by the action of an air spring caused within the cylinder 129 by means of sliding movement of the piston 128. The striker 131 therefore moves with a predetermined time delay with respect to the movement of the piston 128. As shown in FIG. 3, a phase difference (delay with respect to the piston 128) between a point of connection of the second connecting rod 225 to the second crank disc 221 via the second eccentric shaft 223 and a point of connection of the first connecting rod 126 to the first crank disc 124 via the first eccentric shaft 125 is about 270° in the rotational direction (counterclockwise direction as viewed in FIG. 3) of the first and the second crank discs 124 and 221. Therefore, the second motion converting mechanism 213 is arranged to drive the cylinder 129 with a delay of about 270° in terms of a crank angle with respect to the first motion converting mechanism 113.

FIG. 3 schematically shows a relative positional relationship of the piston 128, the cylinder 129 and the first and the second connecting rods 126 and 225 when the hammer 101 is in the state shown in FIG. 2. In FIGS. 2 and 3, the piston 128 is shown at a non-compression side dead point (sliding end when slid toward the driving motor 111, or retracting end).

Operation of the hammer 101 constructed as described above will now be explained. When the driving motor 111 (shown in FIG. 1) is driven, the rotating output of the driving motor 111 causes the driving gear 121 (shown in FIG. 2) to rotate. When the driving gear 122 rotates, the first crank disc 124 rotates via the intermediate gear 122 and the driven gear 123. Then, the first eccentric shaft 123 on the first crank disc 124 revolves, which in turn causes the first connecting rod 126 to swing. The piston 128 on the end of the first connecting rod 126 then slidingly reciprocates within the cylinder 129. When the piston 128 slides toward the hammer bit 119 from the non-compression side dead point, a force of moving the striker 131 toward the hammer bit 119 acts on the striker 131 by the action of the air spring function as a result of the compression of the air within the cylinder 147 between the striker and the impact bolt. Thus, the striker 131 reciprocates within the cylinder 129 at a speed higher than the piston 128 in the same direction and collides with the impact bolt 133. The kinetic energy (striking force) of the striker 131 caused by the collision with the impact bolt 133 is transmitted to the hammer bit 119. Thus, the hammer bit 119 slidingly reciprocates within the tool holder 117 and performs a hammering operation on the workpiece.

FIG. 1 shows the state in which the striker 131 has transmitted the striking force to the hammer bit 119 via the impact bolt 133, while the piston 128 that drives the striker 131 has retracted to the non-compression side dead point after the compression process of the air spring. The actual sliding movement of the striker 131 including collision with the impact bolt 133 occurs with a predetermined time delay after the sliding movement of the piston 128 in relation to the time required for the air spring to act on the striker 131 and the inertial force of the striker 131.

On the other hand, within the second motion converting mechanism 213, the second crank disc 221 rotates as the first eccentric shaft 125 is caused to revolve by rotation of the first crank disc 124. Then, the second eccentric shaft 223 on the second crank disc 221 revolves, which in turn causes the second connecting rod 126 to swing. The cylinder 129 then slidingly reciprocates within the barrel 108.

At this time, the cylinder 129 slides in a direction opposite to the sliding direction of the striker 131 when the striker 131 slides toward the impact bolt 133. This is because, in the hammer, certain time is necessary to drive the striker 131 after the piston 128 starts to compress the air within the air spring chamber 129*a* for increasing the pressure within the air spring chamber 129*a*. Therefore, a phase difference is provided such that the cylinder 129 reciprocates in a direction opposite to the reciprocating direction of the striker 131 with an appropriate timing with respect to the reciprocating movement of the striker 131 (specifically, a phase difference of about 270° is provided between the point of connection of the second connecting rod 225 to the second crank disc 221 and the point of connection of the first connecting rod 126 to the first crank disc 124). According to this embodiment, the cylinder 129 functions as a "counter weight" by actively reciprocating in a direction opposite to the reciprocating direction of the striker 131. As a result, vibration caused in the hammer 101 when the striker 131 collides with the impact bolt 133 can be reduced.

When the piston 128 slides away from the compression side dead point, a force of moving the striker 131 away from the hammer bit 119 acts on the striker 131 by the action of the air spring upon the inflation side (the side opposite to the piston 128). When the piston 128 slides to the non-compression side dead point, the striker 131 starts to slide away from the hammer bit 119. This sliding movement of the striker 131 continues even if the piston 128 reaches the non-compression side dead point and starts to slide in the reverse direction toward the compression side dead point. During the retracting movement of the striker 131 away from the hammer bit 119, the cylinder 129 also slides in a direction opposite to the sliding direction of the striker 131. Thus, the vibration reducing mechanism effectively functions with the actively driven cylinder 129. The weight of the cylinder 129 that functions as a counter weight may appropriately be selected such that a vibration reducing force to be obtained by the cylinder 129 can be maximized. When the cylinder 129 slides within the barrel 108, the capacity of the space within the housing which faces the axial end of the cylinder 129 fluctuates. Preferably, said space may be configured to communicate with the outside in order to reduce pressure fluctuations which are caused by such capacity fluctuations and thus to prevent the capacity fluctuations from interfering with the sliding movement of the cylinder 129.

According to the embodiment, as shown in FIG. 3, the path "P" of the center of gravity of the cylinder 129 substantially coincides with the path "Q" of the center of gravity of the piston 128 and the striker 131. If, for example, the counter weight is disposed in a position displaced from the path of the striker, a rotating moment will be exerted on the cylinder and that may cause another vibration. According to this embodiment, such problem is eliminated and vibration reduction can be performed in a stable manner.

As shown in FIG. 1, the hammer 101 according to this embodiment is constructed as a relatively large-sized hammer including a handgrip 109 on the both right and left sides of the body 103 and mainly used for chipping floors. In a normal manner of using the hammer 101 of this type, the hammer bit 119 is pressed against the workpiece or the floor surface under the own weight of the hammer 101, so that a load is applied to the hammer bit 119. The vibration reducing mechanism 201 is especially useful for such type of hammer because the hammer of this type is normally driven under loaded condition and therefore vibration reducing is always required. Otherwise, if the hammer is driven under unloaded condition, the cylinder 129 that always reciprocates during the operation may uselessly cause vibration.

While, in this embodiment, the striking force of the striker 131 is transmitted to the hammer bit 119 via the impact bolt 133, the present invention can also be applied to the configuration in which the striker 131 directly collides with the hammer bit 119.

SECOND REPRESENTATIVE EMBODIMENT

Figure 4:
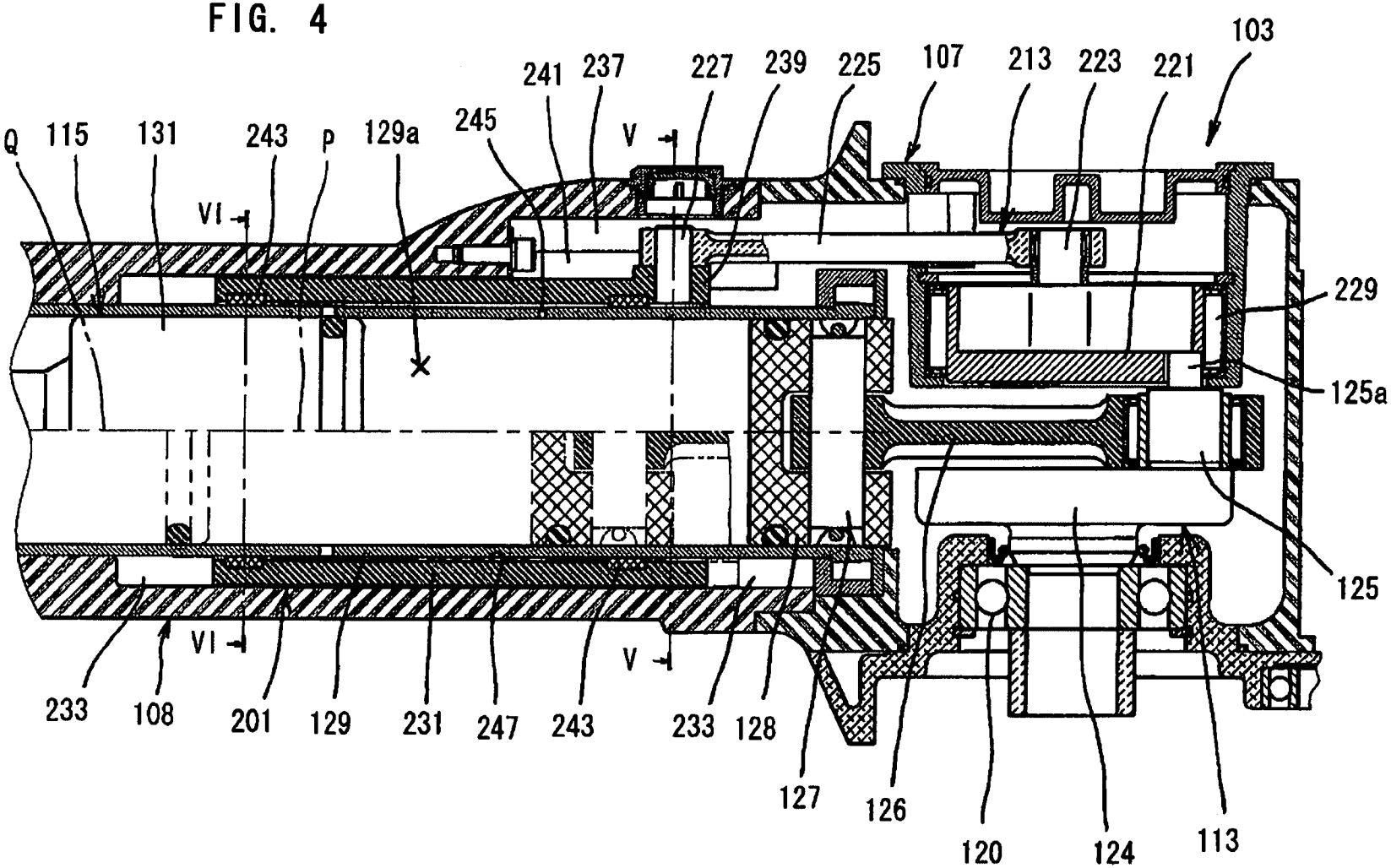
FIG. 4 is a sectional plan view of an essential part of the electric hammer of the second representative embodiment, showing a piston at a non-compression side dead point.
Figure 5:
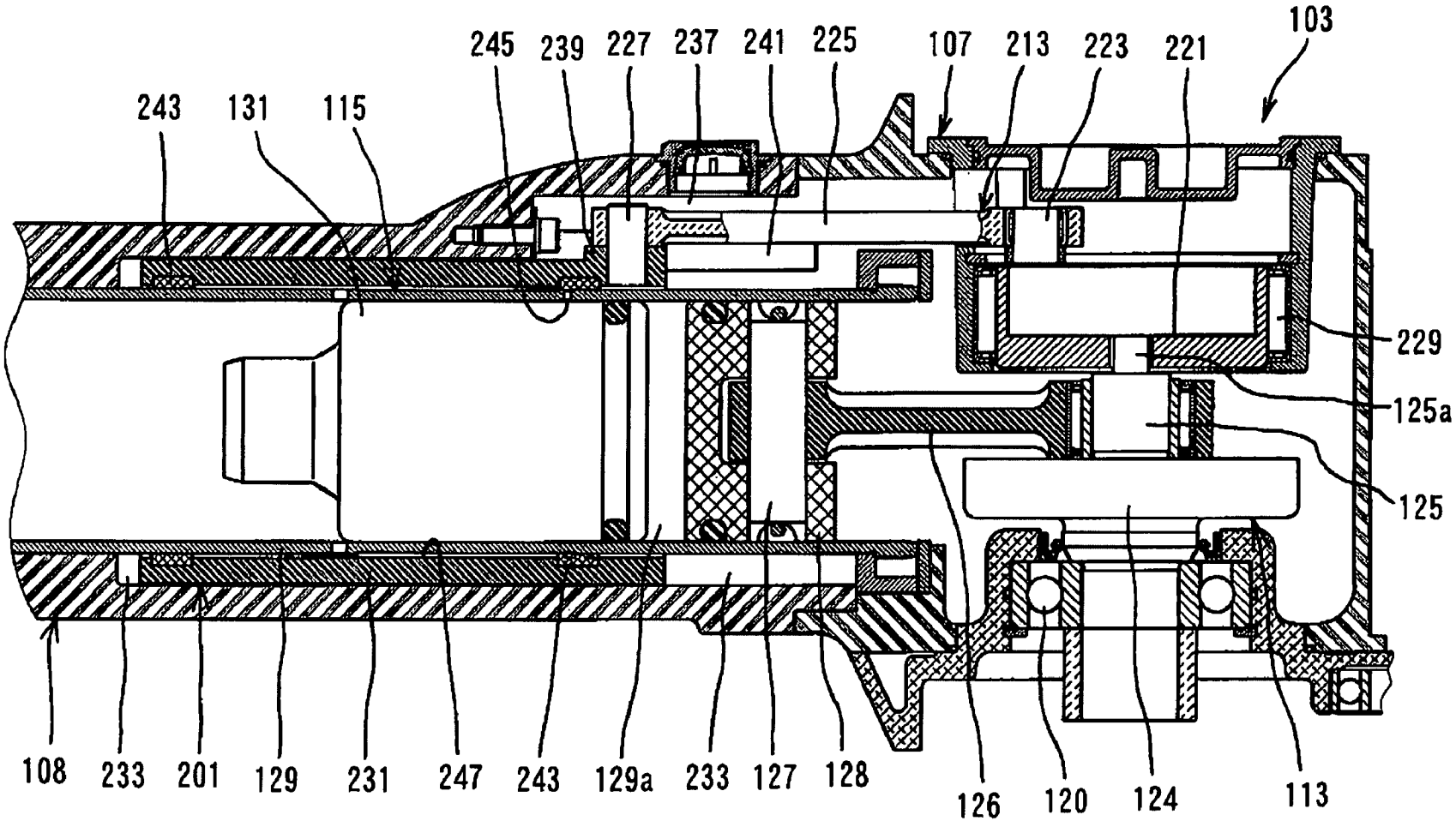
FIG. 5 is a sectional plan view of an essential part of the electric hammer of the second representative embodiment, showing the piston in the maximum compression state having substantially passed the intermediate position.

Second representative embodiment of the present invention is now explained in greater detail in reference to FIGS. 4 to 8. In explaining the second embodiment, features having substantially the same constructions with the respective features utilized in the above-explained first embodiment are shown with same reference numbers in the drawings. As shown in FIGS. 4 and 5, the cylinder 129 of the second representative embodiment is fixedly disposed within the barrel 108 that is connected to the gear housing 107. Further, a cylindrical counter weight 231 is disposed between the outer circumferential surface of the cylinder 129 and the inner circumferential surface of the barrel 108. The cylindrical counter weight 231 can slide in the axial direction of the hammer bit 119 so as to function as a vibration reducing weight during hammering operation by reciprocating in a direction opposite to the sliding direction of the striker 131. A cylindrical accommodation space 233 for accommodating the counter weight 231 is defined between the outer circumferential surface of the cylinder 129 and the inner circumferential surface of the barrel 108. The accommodation space 233 has an axial length long enough to allow the counter weight 231 to slide in its axial direction.

In FIG. 4, a path of the center of gravity of the counter weight 231 that reciprocates within the barrel 108 is shown by reference symbol "P", while a path of the center of gravity of the piston 129 as well as the striker 131 reciprocating within the cylinder 129 is shown by reference symbol "Q". The path P of the center of gravity of the counter weight 231 substantially coincides with the path Q of the center of gravity of the piston 128 and the striker 131.

As shown in FIGS. 4 and 5, the second motion converting mechanism 213 is provided in order to cause the counter weight 231 to reciprocate. The mechanism 213 includes a second crank disc 221, a second eccentric shaft (crank pin) 223 and a second connecting rod 225. The second eccentric shaft 223 is eccentrically disposed in a position displaced from the center of rotation of the second crank disc 221 on the edge portion of the second crank disc 221. One end of the second connecting rod 225 is loosely connected to the second eccentric shaft 223 and the other end is loosely connected to the counter weight 231 via a second connecting shaft 227. The second crank disc 221, the second eccentric shaft 223 and the second connecting rod 225 forms a second crank mechanism. The counter weight 231 reciprocates via the second crank mechanism between the advancing end nearest to the hammer bit 119 and the retracting end remotest from the hammer bit 119.

Figure 6:
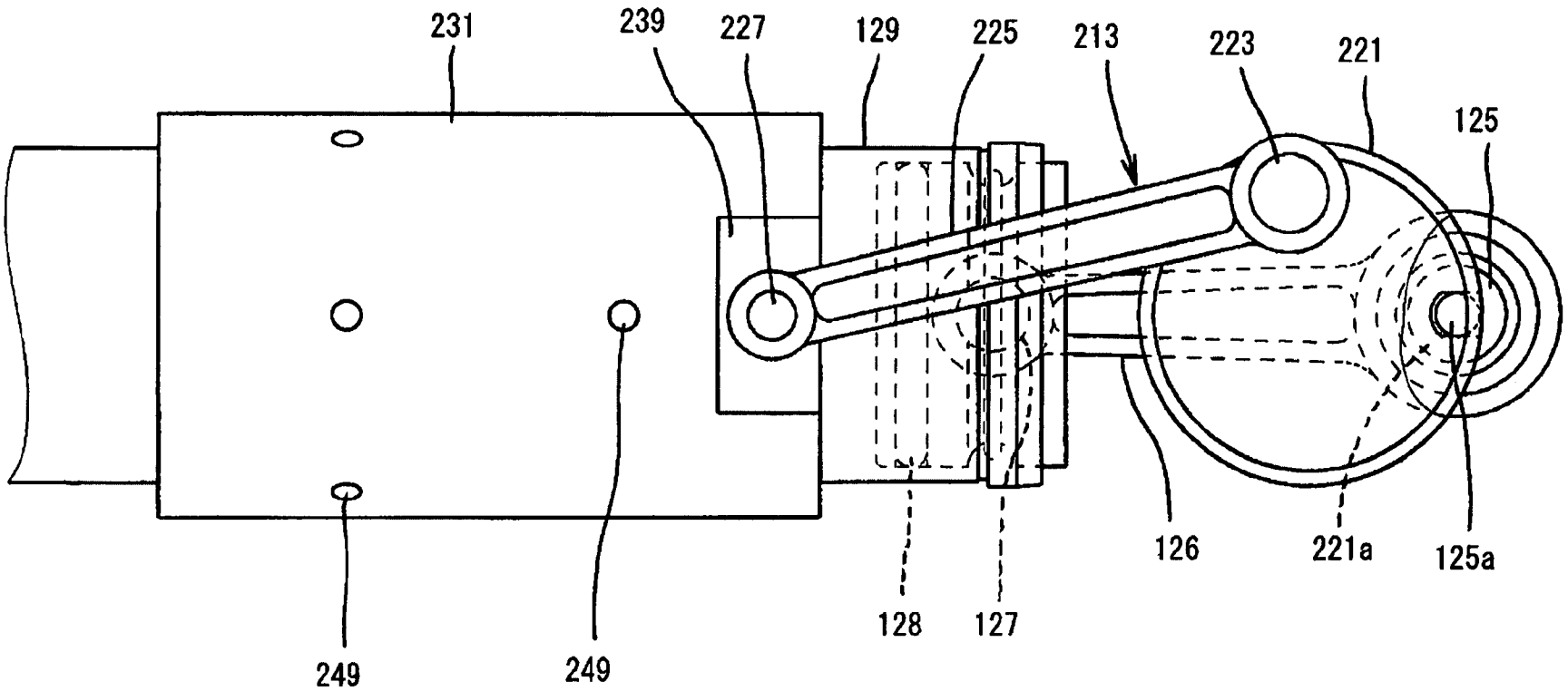
FIG. 6 is a plan view schematically showing a relative positional relationship of the piston, the counter weight and the first and the second connecting rods when the hammer is in the state shown in FIG. 4.

The second crank disc 221 is arranged such that its axis of rotation substantially coincides with the axis of rotation of the first crank disc 124 of the first motion converting mechanism 113. The second crank disc 221 is loosely connected to the first eccentric shaft 125 in a position displaced from its axis of rotation. As shown in FIG. 6, this connection is achieved by the fact that a U-shaped engaging portion 221*a* of the second crank disc 221 loosely engages with a small-diameter portion 125*a* of the first eccentric shaft 125. The second crank disc 221 is rotatably supported by a second bearing 229.

Figure 7:
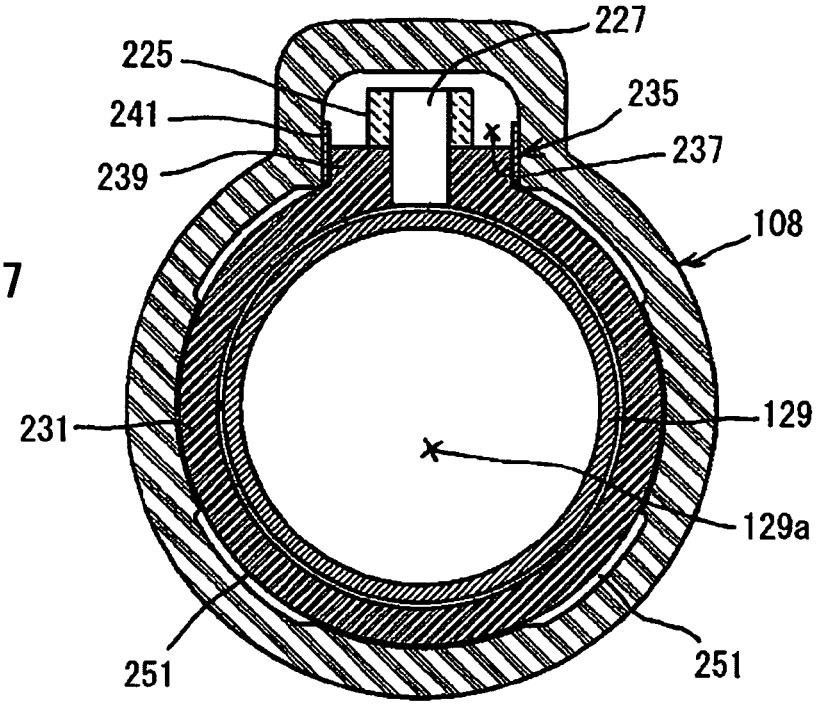
FIG. 7 is a sectional view taken along line V—V in FIG. 4.
Figure 8:
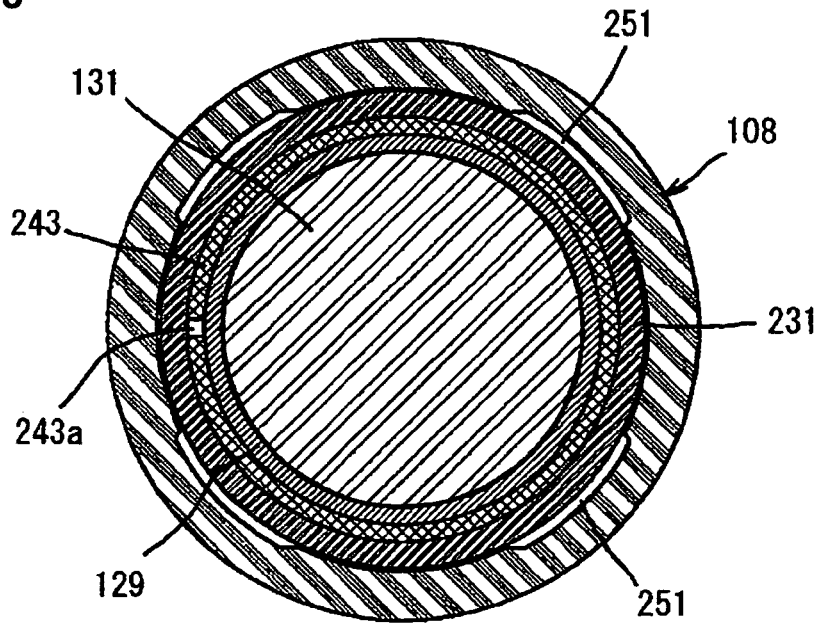
FIG. 8 is a sectional view taken along line VI—VI in FIG. 4.

Further, as shown in FIG. 7, a rotation preventing mechanism 235 is provided in the mounting area of the second connecting shaft 227. Via the shaft 227, the counter weight 231 is connected to the second connecting rod 225. The rotation preventing mechanism 235 prevents the counter weight 231 from moving in its circumferential direction. The rotation preventing mechanism 235 comprises a guide groove 237 and an engaged sliding portion 239. The guide groove 237 is formed in the inside of a portion of the barrel 108 that bulges outside. The engaged sliding portion 239 is formed in the shaft mounting portion on the outer circumferential surface of the counter weight 231 so as to bulge outside. The guide groove 237 extends in a direction parallel to the moving direction of the counter weight 231. The engaged sliding portion 239 slidably engages in the guide groove 237. The counter weight 231 is prevented from moving in its circumferential direction by the engaged sliding portion 239 being in contact with the wall surface of the guide groove 237 in the circumferential direction. In order to achieve smooth sliding movement of the engaged sliding portion 239 along the guide groove 237, a slide plate 241 is disposed on the sliding surface between the guide groove 237 and the engaged sliding portion 239. The guide groove 237 and the engaged sliding portion 239 form an engaged sliding structure along the entire extent of movement of the counter weight 231.

In this embodiment, a phase difference is provided between the reciprocating movement of the piston 128 and the reciprocating movement of the counter weight 231 such that the counter weight 231 reciprocates in a direction opposite to the reciprocating direction of the striker 131 that applies an impact force to the hammer bit 119 via the impact bolt 133. As shown in FIG. 6, a phase difference between a point of connection of the second connecting rod 225 to the second crank disc 221 via the second eccentric shaft 223 and a point of connection of the first connecting rod 126 to the first crank disc 124 via the first eccentric shaft 125 is about 260° in the rotational direction (counterclockwise direction as viewed in FIG. 6) of the first and the second crank discs 124 and 221.

As shown in FIGS. 4 and 5, a slide ring 243 is provided on the inner circumferential surface of the counter weight 231 on its both ends in the sliding direction in order to achieve smooth sliding movement of the counter weight 231. As particularly shown in FIG. 8, the slide ring 243 has a C-ring shape with a notch 243*a* in a circumferential portion. The slide ring 243 is fitted in a groove 231*a* formed in the inner circumferential surface of the counter weight 231. The slide ring 243 is formed of a synthetic resin, such as polyacetal, which is slippery and highly resistant to wear.

Further, as shown in FIGS. 4 and 5, an air vent 245 for controlling the pressure within the air spring chamber 129*a* is formed in the cylinder 129. The air vent 245 communicates the air spring chamber 129*a* with the outside (the crank chamber) via a clearance 247, communication holes 249, passages 251. The clearance 247 is defined between the outer circumferential surface of the cylinder 129 and the inner circumferential surface of the counter weight 231. Communication holes 249 are formed in the counter weight 231. Passages 251 (see FIG. 7) are formed between the outer circumferential surface of the counter weight 231 and the inner circumferential surface of the barrel 108. The passages are arranged at predetermined intervals in the circumferential direction. As to the above-explained slide rings 243, the rear one (right one as viewed in the drawings) opens and closes the air vent 245. Specifically, the rear slide ring 243 comprises an opening-and-closing valve for opening and closing the air vent 245. The rear slide ring 243 will be hereinafter referred to as an opening-and-closing valve.

The opening-and-closing valve 243 is in sliding contact with the outer circumferential surface of the cylinder 129 while exerting a predetermined biasing force on it. Then, when the air vent 245 is closed, the inside is kept airtight. The opening-and-closing valve 243 closes the air vent 245 in a predetermined region (in the range of about 160 to 200° by the crank angle of the second crank mechanism, taking the position of the retracting end as 0° (360°)) in the neighborhood of the advancing end within the range of movement of the counter weight 231 (see FIG. 6), while it opens the air vent 245 in the other region. In other words, the opening-and-closing valve 243 closes the air vent 245 in an effective compression region (in the range of about 60 to 100° by the crank angle of the first crank mechanism) in obtaining a strong striking force of the striker 131 in the process of compression by the piston 128, while it opens the air vent 245 in a region other than the effective compression region.

Operation of the hammer 101 constructed as described above will now be explained. When the driving motor (not particularly shown in the drawings) is driven, the rotating output of the driving motor causes the first crank disc 124 (shown in FIG. 4) to rotate. As a result, the first eccentric shaft 123 on the first crank disc 124 revolves, which in turn causes the first connecting rod 126 to swing. The piston 128 on the end of the first connecting rod 126 then slidingly reciprocates within the cylinder 129 to drive the striker 131.

On the other hand, as to the second motion converting mechanism 213, the second crank disc 221 rotates as the first eccentric shaft 125 is caused to revolve by rotation of the first crank disc 124. Then, the second eccentric shaft 223 on the second crank disc 221 revolves, which in turn causes the second connecting rod 126 to swing. The counter weight 231 then slidingly reciprocates along the outer circumferential surface of the cylinder 129. The counter weight 231 slides in a direction opposite to the sliding direction of the striker 131 when the striker 131 slides toward the impact bolt 133. This is because a phase difference is provided such that the counter weight 231 reciprocates in a direction opposite to the reciprocating direction of the striker 131 with an appropriate timing with respect to the reciprocating movement of the striker 131.

According to the second representative embodiment, the counter weight 231 is caused to reciprocate in its axial direction with such timing as to correspond to the impact force by the striking movement of the hammer bit 119. In this manner, vibration caused in the hammer 101 can be alleviated.

When the piston 128 moves toward the compression side dead point and reaches the intermediate region (in the range of about 60 to 100° by the crank angle of the first crank mechanism), the air spring chamber 129*a* is in the optimum compression region, and when it is in a position of about 100° by the crank angle, it is in the maximum compression state (see FIG. 5). At this time, the counter weight 231 which is driven with a delay of about 260° with respect to the piston 128 is located in a region (in the range of about 160 to 200° by the crank angle of the second crank mechanism) in the neighborhood of the advancing end nearest to the hammer bit 119. In this region, the opening-and-closing valve 243 on the counter weight 231 closes the air vent 245. This means that the opening-and-closing valve 243 closes the air vent 245 when the air spring chamber 129*a* is in the optimum compression region. Therefore, communication of the air spring chamber 129*a* with the outside is interrupted, so that air within the air spring chamber 129*a* is prevented from flowing out to the outside. As a result, loss the compression efficiency within the cylinder can be improved and the striker 131 can produce a stronger striking force.

When the piston 128 slides away from the hammer bit 119 from the compression side dead point, the counter weight 231 is moved in the retracting direction from the advancing end. At this time, the opening-and-closing valve 243 opens the air vent 245, so that the air spring chamber 129*a* communicates with the outside. Thus, the outside air is introduced into the air spring chamber 129*a* and the suction force within the cylinder is weakened. As a result, the striker 131 is prevented from moving toward the piston 128 beyond its proper position.

In regard to the timing for the opening-and-closing valve 243 to open and close the air vent 245, in this embodiment, it closes the air vent 245 in the range of about 160 to 200° by the crank angle of the second crank mechanism. However, this timing can be appropriately set by adjusting the width (ring width) of the opening-and-closing valve 243 in the moving direction, in consideration of the effectiveness of preventing outflow of the air within the air spring chamber 129*a* and the optimization of the return movement of the striker 131.

Further, when the counter weight 231 slides along the outer circumferential surface of the cylinder 129, the capacity of the accommodation space 233 which faces the axial end of the counter weight 231 fluctuates. In this embodiment, however, the accommodation space 233 communicates with the crank chamber via the passages 251 that comprise grooves formed in the inner circumferential surface of the barrel 108. Therefore, pressure fluctuations caused within the accommodation space 233 by the capacity fluctuations can be reduced and thus, the counter weight 231 can smoothly slide.

In this embodiment, the counter weight 231 is disposed between the barrel 108 and the outer circumferential surface of the cylinder 129 and serves to reduce vibration on the striker 131 by reciprocating in a direction opposite to the reciprocating direction of the striker 131. For this purpose, the accommodation space 233 for the counter weight 231 is provided between the outer circumferential surface of the cylinder 129 and the barrel 108. By such construction, a space for accommodating the counter weight 231 can be ensured without substantial change in the appearance of the barrel 108.

Further, in this embodiment, a path P of the center of gravity of the counter weight 231 substantially coincides with the path Q of the center of gravity of the piston 128 and the striker 131. As a result, vibration reduction can be performed in a stable manner.

When the second crank mechanism is driven, the counter weight 231 may possibly receive a force (rotational force) to move the counter weight 231 in its circumferential direction via the second connecting shaft 227. According to the second embodiment, as shown in FIGS. 4 and 7, the rotation preventing mechanism 235 bears such rotational force so that the counter weight 231 is prevented from moving in its circumferential direction. Therefore, in spite of the above mentioned rotational force, stable reciprocating movement of the counter weight 231 can be ensured. In addition, unintentional torsion can be prevented from acting on the second connecting shaft 227, the second connecting rod 225 and the second eccentric shaft 223 so that the counter weight 231 can move with stability.

In this embodiment, as shown in FIGS. 4 and 5, the first crank disc 124 of the first motion converting mechanism 113 is rotatably supported by a first bearing 120. The second crank disc 221 of the second motion converting mechanism 213 is rotatably supported by a second bearing 229. Further, the first crank disc 124 is connected to the second crank disc 221 via the first eccentric shaft 125. With this construction, the first crank disc 124, the first eccentric shaft 125 and the second crank disc 221 are supported as one integral rigid body by the first and the second bearings 120, 229. As a result, such rotation driving mechanism can be driven with stability.

Further, in this embodiment, the axial length (length in the moving direction) of the counter weight 231 is designed to be larger than the outer diameter of the cylinder 129. As a result, the counter weight 231 is prevented from tilting with respect to the axis of the cylinder 129 due to the existence of a clearance between the cylinder and the counter weight. As a result, the stability of the reciprocating movement of the counter weight 231 along the cylinder 129 is improved.

Although, in the second embodiment, the driving force of the counter weight 231 is inputted from one side (upper side as viewed in FIGS. 4 and 5) of the axis of movement of the counter weight 231, it may be inputted from the both sides. For this purpose, a motion converting mechanism (crank mechanism) similar to the second motion converting mechanism 213 may be provided symmetrically on the opposite side of the first motion converting mechanism 113 with respect to the second motion converting mechanism 213. Specifically, in FIG. 4, a crank disk may be provided on the opposite side (lower side as viewed in FIG. 4) of the bearing 123*a* that supports the shaft of the driven gear 123, with respect to the driven gear 123. In such case, one end of a connecting rod may be rotatably connected to the crank disc via an eccentric shaft, while the other end may be rotatably connected to the counter weight 231 via a connecting shaft.

With such modification, the driving force of the counter weight 231 can be inputted parallel to each other from the both sides of the axis of movement of the counter weight 231. Thus, the counter weight 231 can slide with stability. Further, the rotation preventing mechanism can be omitted.

DESCRIPTION OF NUMERALS

101 electric hammer (power tool)
103 body
105 motor housing
107 gear housing
108 barrel
109 hand grip
111 driving motor
113 first motion converting mechanism
115 striking mechanism
117 tool holder
119 hammer bit (tool bit)
121 driving gear
122 intermediate gear
123 driven gear
124 first crank disc
125 first eccentric shaft
125*a* small-diameter portion
126 first connecting rod
127 first connecting shaft
128 piston (driver)
129 cylinder
131 striker
133 impact bolt
201 vibration reducing mechanism
213 second motion converting mechanism
221 second crank disc
221*a* engaging portion
223 second eccentric shaft
225 second connecting rod
227 second connecting shaft
229 joint ring
231 counter weight
231*a* groove
233 accommodation space
235 rotation preventing mechanism
237 guide groove
239 engaged sliding portion
241 slide plate
243 slide ring (opening-and-closing valve)
243*a* notch
245 air vent
247 clearance
249 communication hole
251 passage

What we claim is:

1. A power tool, comprising:

a body, a cylinder that is housed within the body, a striker that reciprocates by pressure fluctuations within the cylinder, a tool bit that performs a predetermined operation by a striking force of the striker and a counter weight that is disposed along the entirety or part of the outer circumferential surface of the cylinder and caused to reciprocate with such timing as to correspond to an impact force during hammering operation to reduce vibration against the impact force.

2. The power tool as defined in claim 1 further comprising a rotation preventing mechanism disposed between the body and the counter weight so as to prevent the counter weight from moving in a circumferential direction.

3. The power tool as defined in claim 1, wherein the power tool includes an air vent through which outside air is introduced into the cylinder when the pressure within the cylinder decreases, the air vent being opened and closed when the counter weight reciprocates on the cylinder.

4. The power tool as defined in claim 1, further comprising first and second crank mechanisms:

wherein the first crank mechanism drives a driver reciprocating within the cylinder so as to increase and decrease the pressure within the cylinder, the first crank mechanism including a first crank disk driven by the driving motor, a first bearing that rotatably supports the crank disk, a first eccentric shaft disposed on the first crank disk and a first connecting rod, one end of the first connecting rod being rotatably connected to the first eccentric shaft and the other end of the first connecting rod being rotatably connected to the striker via the first connecting shaft and wherein the second crank mechanism drives the counter weight to reciprocate, the second crank mechanism including a second crank disk rotatably connected to the first eccentric shaft and rotatably supported by the second bearing on the same axis as the axis of rotation of the first crank disc, a second eccentric shaft disposed on the second crank disk and a second connecting rod, one end of the second connecting rod being rotatably connected to the second eccentric shaft and the other end of the second connecting rod being rotatably connected to the counter weight via the second connecting shaft.

* * * * *